US011272755B2

(12) United States Patent
Christensen et al.

(10) Patent No.: US 11,272,755 B2
(45) Date of Patent: Mar. 15, 2022

(54) SOLE AND ARTICLE OF FOOTWEAR HAVING A POD ASSEMBLY

(71) Applicant: REEBOK INTERNATIONAL LIMITED, London (GB)

(72) Inventors: Brian Christensen, Centerville, MA (US); William Marvin, Canton, MA (US); Paul E. Litchfield, Westborough, MA (US)

(73) Assignee: REEBOK INTERNATIONAL LIMITED, London (GB)

( * ) Notice: Subject to any disclaimer, the term of this patent is extended or adjusted under 35 U.S.C. 154(b) by 400 days.

(21) Appl. No.: 16/246,849

(22) Filed: Jan. 14, 2019

(65) Prior Publication Data

US 2019/0142103 A1 May 16, 2019

Related U.S. Application Data

(63) Continuation of application No. 13/849,395, filed on Mar. 22, 2013, now Pat. No. 10,178,891.

(51) Int. Cl.

| | |
|---|---|
| ***A43B 3/00*** | (2006.01) |
| ***A43B 13/20*** | (2006.01) |
| ***A43B 7/14*** | (2006.01) |
| ***A43B 7/1425*** | (2022.01) |
| ***A43B 7/144*** | (2022.01) |

(Continued)

(52) U.S. Cl.

CPC ..... *A43B 3/0057* (2013.01); *A43B 7/144* (2013.01); *A43B 7/145* (2013.01); *A43B 7/148* (2013.01); *A43B 7/1425* (2013.01); *A43B 7/1445* (2013.01); *A43B 13/16* (2013.01); *A43B 13/20* (2013.01); *A43B 13/206* (2013.01)

(58) Field of Classification Search

CPC ..... A43B 3/0057; A43B 7/1425; A43B 7/144; A43B 7/1445; A43B 7/145; A43B 13/16; A43B 13/20; A43B 13/206; A43B 7/14; A43B 7/141; A43B 7/1415; A43B 7/148; A43B 13/12; A43B 13/122; A43B 13/125; A43B 13/127

USPC ..... 36/102, 29, 153, 35 B; D2/961

See application file for complete search history.

(56) References Cited

U.S. PATENT DOCUMENTS

| | | | |
|---|---|---|---|
| 1,344,972 | A | 6/1920 | Armour |
| 2,090,881 | A | 8/1937 | Wilson |

(Continued)

FOREIGN PATENT DOCUMENTS

| | | | |
|---|---|---|---|
| GB | 2 201 082 | A | 8/1988 |
| JP | 05176803 | A | 7/1993 |

(Continued)

OTHER PUBLICATIONS

European Search Report for European Application No. 12199619.3, European Patent Office, The Netherlands, dated Apr. 24, 2013, 6 pages.

*Primary Examiner* — Jameson D Collier

(74) *Attorney, Agent, or Firm* — Sterne, Kessler, Goldstein & Fox P.L.L.C.

(57) ABSTRACT

A sole for an article of footwear includes: an upper sole portion; and a pod assembly having a plurality of pods fluidly connected in series disposed below the upper sole portion, wherein the pod assembly extends from a lateral heel portion of the sole to a medial forefoot portion of the sole such that the plurality of pods compress substantially in sequence through a gait cycle of a wearer.

19 Claims, 11 Drawing Sheets

(51) Int. Cl.

| | |
|---|---|
| ***A43B 7/1445*** | (2022.01) |
| ***A43B 7/145*** | (2022.01) |
| ***A43B 13/16*** | (2006.01) |
| ***A43B 7/148*** | (2022.01) |

(56) References Cited

U.S. PATENT DOCUMENTS

| | | | |
|---|---|---|---|
| 3,050,875 | A | 8/1962 | Robbins |
| 4,112,599 | A | 9/1978 | Krippelz |
| 4,183,156 | A | 1/1980 | Rudy |
| 4,345,387 | A | 8/1982 | Daswick |
| 4,358,902 | A | 11/1982 | Cole et al. |
| 4,577,417 | A | 3/1986 | Cole |
| 4,763,426 | A | 8/1988 | Polus et al. |
| D315,634 | S | 3/1991 | Yung-Mao |
| 4,999,931 | A | 3/1991 | Vermeulen |
| 5,195,257 | A | 3/1993 | Holcomb et al. |
| 5,313,717 | A | 5/1994 | Allen et al. |
| 5,375,346 | A | 12/1994 | Cole et al. |
| 5,395,674 | A | 3/1995 | Schmidt et al. |
| 5,406,719 | A | 4/1995 | Potter |
| 5,416,986 | A | 5/1995 | Cole et al. |
| 5,493,792 | A | 2/1996 | Bates et al. |
| 5,664,341 | A | 9/1997 | Schmidt et al. |
| 5,679,439 | A | 10/1997 | Schmidt et al. |
| 5,701,687 | A | 12/1997 | Schmidt et al. |
| D391,751 | S | 3/1998 | Santos et al. |
| 5,753,061 | A | 5/1998 | Rudy |
| 5,771,606 | A | 6/1998 | Litchfield et al. |
| D395,744 | S | 7/1998 | Edington et al. |
| 5,794,359 | A | 8/1998 | Jenkins |
| 5,826,349 | A | 10/1998 | Goss |
| 5,842,291 | A | 12/1998 | Schmidt et al. |
| 5,916,664 | A | 6/1999 | Rudy |
| 6,018,889 | A | 2/2000 | Friton |
| 6,122,785 | A | 9/2000 | Bondie et al. |
| 6,258,421 | B1 | 7/2001 | Potter |
| 6,266,897 | B1 | 7/2001 | Seydel et al. |
| 6,354,020 | B1 | 3/2002 | Kimball et al. |
| 6,453,577 | B1 | 9/2002 | Litchfield et al. |
| 6,505,420 | B1 | 1/2003 | Litchfield et al. |
| 6,516,540 | B2 | 2/2003 | Seydel et al. |
| 6,722,059 | B2 | 4/2004 | Robinson, Jr. et al. |
| 6,845,573 | B2 | 1/2005 | Litchfield et al. |
| 6,915,594 | B2 | 7/2005 | Kim |
| 7,181,867 | B2 | 2/2007 | Litchfield et al. |
| 7,200,955 | B2 | 4/2007 | Foxen |
| 7,316,081 | B1 | 1/2008 | Cheng |
| 7,448,150 | B1 | 11/2008 | Davis et al. |
| 7,475,498 | B2 | 1/2009 | Litchfield et al. |
| 7,600,331 | B2 | 10/2009 | Litchfield et al. |
| 7,784,196 | B1 | 8/2010 | Christensen et al. |
| 7,797,856 | B2 | 9/2010 | Andrews et al. |
| D625,909 | S | 10/2010 | Skaja et al. |
| D626,736 | S | 11/2010 | Skaja et al. |
| D627,549 | S | 11/2010 | Skaja et al. |
| 7,930,839 | B2 | 4/2011 | Litchfield et al. |
| 10,178,891 | B2 * | 1/2019 | Christensen ..... A43B 3/0057 |
| 2005/0028404 | A1 | 2/2005 | Marvin et al. |
| 2005/0268490 | A1 | 12/2005 | Foxen |
| 2006/0156575 | A1 | 7/2006 | Lo |
| 2007/0169376 | A1 | 7/2007 | Hatfield et al. |
| 2009/0165333 | A1 | 7/2009 | Litchfield et al. |
| 2010/0251565 | A1 | 10/2010 | Litchfield et al. |
| 2011/0131832 | A1 | 6/2011 | Brandt et al. |
| 2011/0203134 | A1 | 8/2011 | Sartor |
| 2011/0277346 | A1 | 11/2011 | Peyton et al. |
| 2012/0023776 | A1 | 2/2012 | Skaja et al. |
| 2013/0167401 | A1 | 7/2013 | Christensen et al. |
| 2013/0167402 | A1 | 7/2013 | Christensen et al. |
| 2013/0212909 | A1 | 8/2013 | Bates et al. |
| 2013/0276329 | A1 | 10/2013 | James |
| 2015/0272271 | A1 | 10/2015 | Campos, II et al. |

FOREIGN PATENT DOCUMENTS

| | | |
|---|---|---|
| WO | WO 98/09546 A1 | 3/1998 |
| WO | WO 01/19211 A1 | 3/2001 |

* cited by examiner

SOLE AND ARTICLE OF FOOTWEAR HAVING A POD ASSEMBLY

CROSS-REFERENCE TO RELATED APPLICATION

This application is a continuation of U.S. patent application Ser. No. 13/849,395, filed Mar. 22, 2013, titled "Sole and Article of Footwear Having a Pod Assembly," the disclosure of which is incorporated herein in its entirety by reference thereto.

BACKGROUND OF THE INVENTION

Field of the Invention

Embodiments of the present invention generally relate to footwear, and more particularly relate to a sole and article of footwear having a pod assembly.

Background Art

Individuals are often concerned with the amount of cushioning an article of footwear provides, as well as the aesthetic appeal of the article of footwear. This is true for articles of footwear worn for non-performance activities, such as a leisurely stroll, and for performance activities, such as running, because throughout the course of an average day, the feet and legs of an individual are subjected to substantial impact forces. When an article of footwear contacts a surface, considerable forces may act on the article of footwear and, correspondingly, the wearer's foot. The sole functions, in part, to cushion to the wearer's foot and to protect it from these forces. To achieve adequate cushioning, many footwear soles are relatively thick and heavy. When sole size and/or weight are reduced to achieve other performance goals, protection of the wearer's foot is often compromised.

The human foot is a complex and remarkable piece of machinery, capable of withstanding and dissipating many impact forces. The natural padding of fat at the heel and forefoot, as well as the flexibility of the arch, help to cushion the foot. An athlete's stride is partly the result of energy which is stored in the flexible tissues of the foot. For example, a typical gait cycle for running or walking begins with a "heel strike" and ends with a "toe-off". During the gait cycle, the main distribution of forces on the foot begins adjacent to the lateral side of the heel (outside of the foot) during the "heel strike" phase of the gait, then moves toward the center axis of the foot in the arch area, and then moves to the medial side of the forefoot area (inside of the foot) during "toe-off". During a typical walking or running stride, the Achilles tendon and the arch stretch and contract, storing and releasing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during every day activity, especially on hard man-made surfaces. Unless an individual is wearing shoes which provide proper cushioning and support, the soreness and fatigue associated with every day activity is more acute, and its onset accelerated. The discomfort for the wearer that results may diminish the incentive for further activity. Equally important, inadequately cushioned footwear can lead to injuries such as blisters; muscle, tendon and ligament damage; and bone stress fractures. Improper footwear can also lead to other ailments, including back pain.

Proper footwear should complement the natural functionality of the foot, in part, by incorporating a sole (typically including an outsole, midsole and insole) which absorbs shocks. Therefore, a continuing need exists for innovations in providing cushioning to articles of footwear.

BRIEF SUMMARY OF THE INVENTION

In one embodiment, a sole for an article of footwear includes: an upper sole portion; and a pod assembly having a plurality of pods fluidly connected in series disposed below the upper sole portion, wherein the pod assembly extends from a lateral heel portion of the sole to a medial forefoot portion of the sole such that the plurality of pods compress substantially in sequence through a gait cycle of a wearer.

In another embodiment, a sole for an article of footwear includes: a foam upper sole portion; and a pod assembly disposed below the upper sole portion, the pod assembly having at least five pods fluidly connected in series in a substantially curved arrangement extending from first end pod disposed in a lateral heel portion of the sole to a second end pod disposed in a medial forefoot portion of the sole.

In yet another embodiment, an article of footwear includes: an upper; an upper sole portion attached to the upper; a pod assembly disposed below the upper sole portion, the pod assembly having a plurality of pods fluidly connected in series disposed below the upper sole portion, wherein the pod assembly extends from a lateral heel portion of the sole to a medial forefoot portion of the sole such that the plurality of pods compress substantially in sequence through a gait cycle of a wearer; and a lower sole portion disposed below the pod assembly.

In another embodiment, a sole for an article of footwear, includes: a first end pod disposed in a lateral heel portion of the sole and corresponding with a heel strike event during a gait cycle of a wearer; a second end pod disposed in a medial forefoot portion of the sole; a plurality of metatarsal pods disposed in between the first end pod and the second end pod and extending from a medial side of the sole to a lateral side of the sole; and a plurality of longitudinal pods extending longitudinally between the first end pod and the plurality of metatarsal pods. The first end pod is fluidly connected in series with the second end pod.

In another embodiment, a sole for an article of footwear includes: an upper sole portion having a heel portion, a midfoot portion, and a forefoot portion; a first fluid filled pod assembly disposed below the upper sole portion, including: a heel pod disposed in a lateral heel portion of the sole, and a plurality of longitudinal pods extending longitudinally in a curved arrangement along the length of the sole from the heel portion to the midfoot portion, wherein the heel pod and the plurality of longitudinal pods are fluidly connected in series; and a second fluid filled pod assembly disposed below the upper sole portion, including: a plurality of metatarsal pods extending from a medial side of the sole to a lateral side of the sole in the forefoot portion. The plurality of pods is adapted to compress substantially in sequence through a gait cycle of a wearer.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
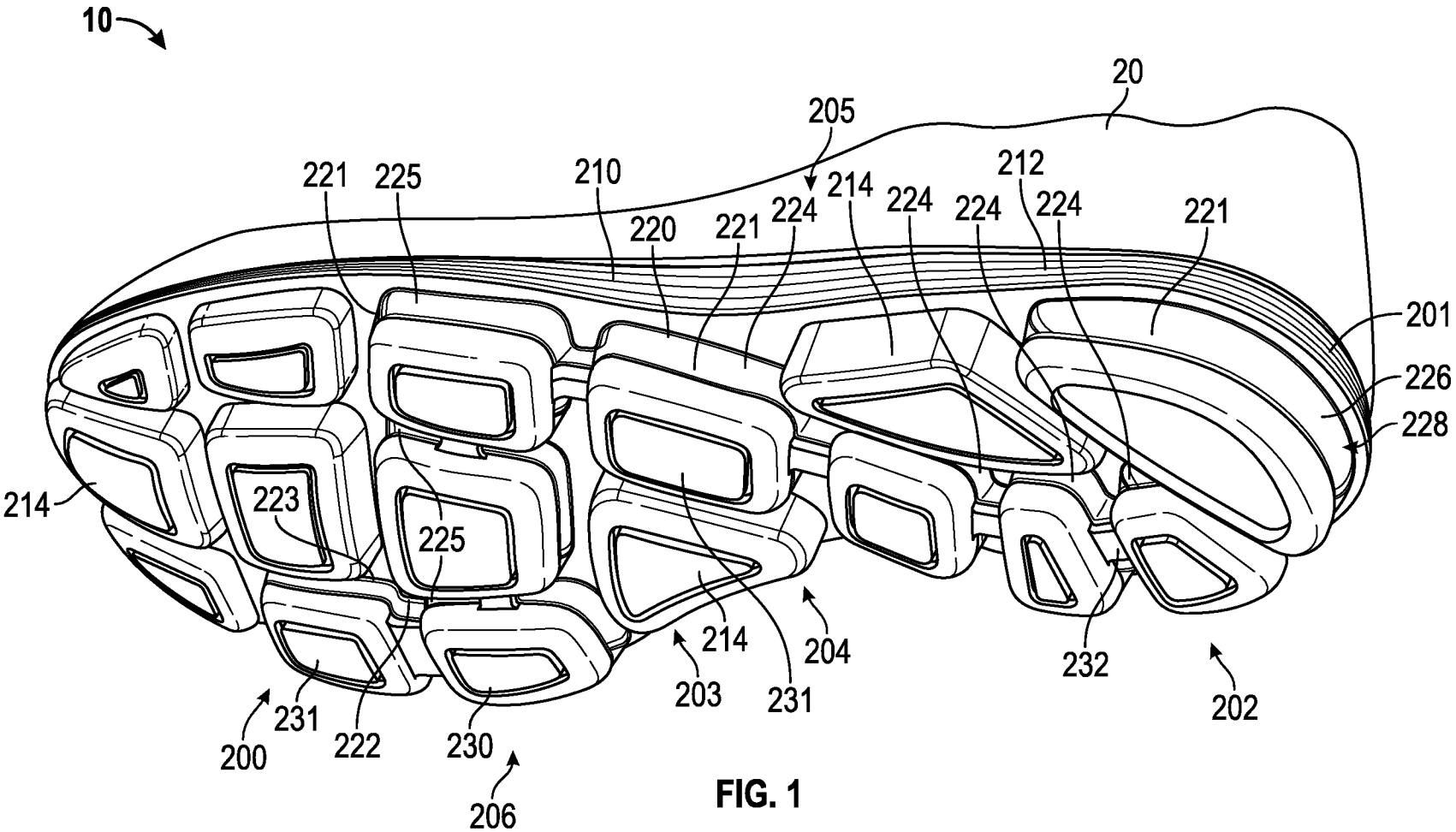
FIG. 1 is a bottom lateral perspective view of an exemplary article of footwear having a sole with a pod assembly according to an embodiment of the present invention.

The present invention will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present invention. Other suitable modifications and adaptations of the variety of conditions and parameters normally encountered in the field, and which would be apparent to those skilled in the art, are within the spirit and scope of the invention.

Embodiments of the present invention include an article of footwear 10 having an upper 20 and a sole 200 coupled to the upper 20. With reference to FIG. 1, the sole 200 includes an upper sole portion 210 coupled to the upper 20 and a pod assembly 220 disposed below the upper sole portion 210. The sole 200 includes a heel region 202, a midfoot or arch region 204, and a forefoot region 206. The pod assembly 220 includes a plurality of fluid filled pods 221 that are fluidly connected in series and disposed below the upper sole portion 210 such that the pod assembly 220 extends from a lateral side 205 heel portion of the sole 200 to a medial side 203 forefoot portion of the sole 200. In this manner, the pod assembly 220 is disposed such that the plurality of pods 221 compress substantially in sequence through a gait cycle of a wearer.

Figure 2:
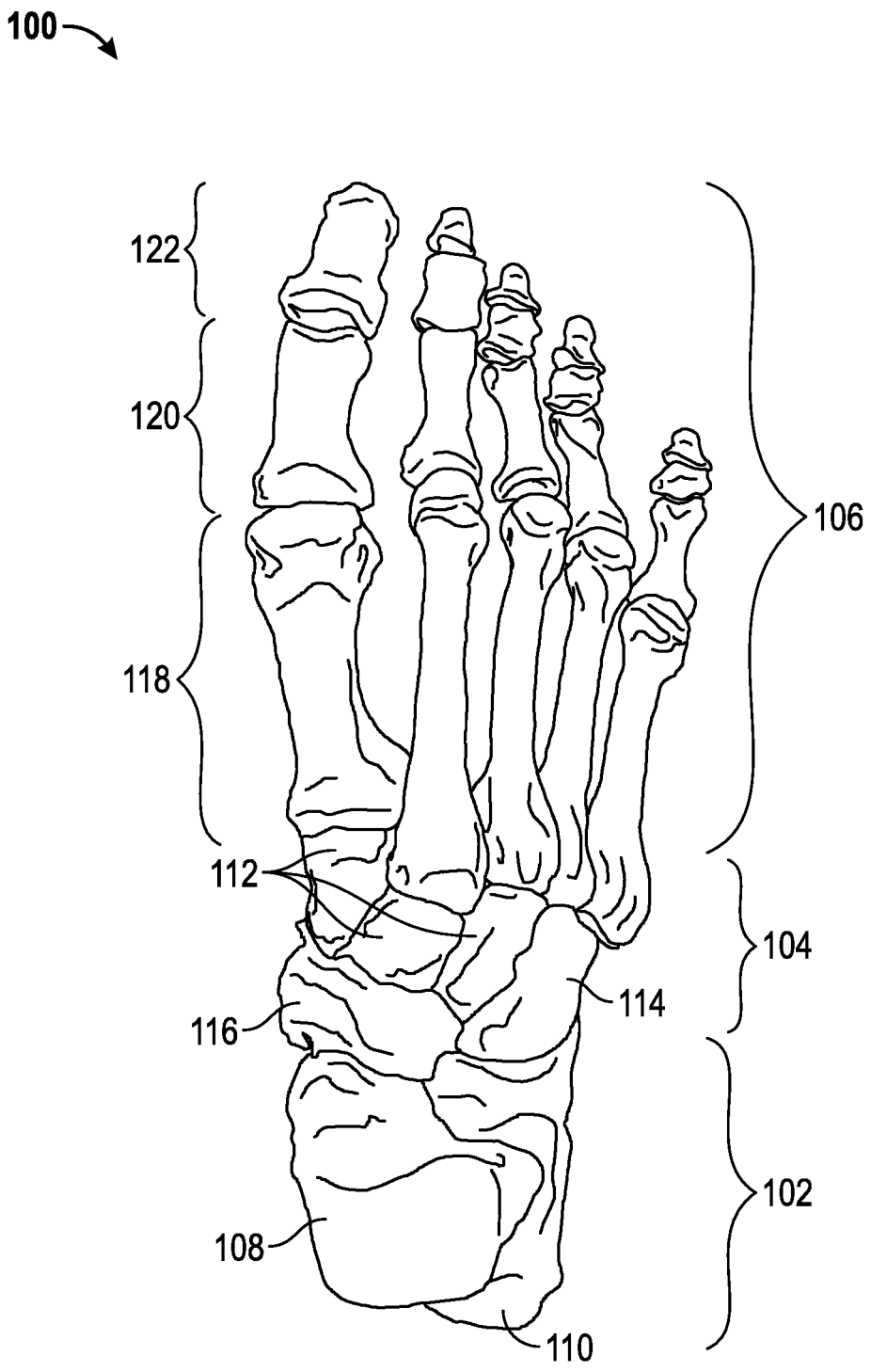
FIG. 2 is an exemplary skeletal depiction of a foot of a wearer.

As a result, embodiments of the present invention are adapted to provide a desired level of cushioning through the gait cycle of the wearer. The human foot has a complex bone structure, capable of withstanding and dissipating many impact forces. FIG. 2 shows a skeletal depiction of the foot 100. There are three main divisions to the foot. Portions of the foot include rear foot 102, midfoot 104, and forefoot 106. The rear foot 102 includes the talus 108 and the calcaneus 110. The midfoot 104 includes three cuneiforms 112, cuboid 114 and navicular 116. The forefoot 106 includes metatarsal 118, proximal phalanges 120, and distal phalanges 122. In one embodiment, the heel region 202, midfoot region 204, and forefoot region 206 of the sole 200 may generally correspond with the rear foot 102, midfoot 104, and forefoot 106. During a typical gait cycle, the main distribution of forces on the foot begins adjacent the lateral side of the heel during the "heel strike" phase of the gait, moves toward the center axis of the foot in the arch area at mid-stride, rolls medially and then moves to the medial side of the forefoot area during "toe-off" Because the pod assembly 220 extends from a lateral side 205 heel portion of the sole 200 to a medial side 203 forefoot portion of the sole 200 and is disposed such that the plurality of pods 221 compress substantially in sequence through a gait cycle of a wearer, embodiment of the present invention are adapted to properly cushion the complex bone structure of the foot and the impact forces acting thereon during a typical gait cycle.

In one embodiment, as shown, for example, in FIGS. 1 and 3-5, the pod assembly 220 is hollow and includes a plurality of pods 221 fluidly connected by a passageway 222 or a plurality of passageways 222. In one embodiment, fluid passageway 222 fluidly connects two pods 221 to permit a contained material to flow between the pods in response to forces applied to the bottom of the wearer's foot. In one embodiment, the pod assembly 220 is filled with air at ambient pressure. In other embodiments, the pod assembly 220 may be filled with a fluid (e.g., a liquid or a gas such as ambient or pressurized air at a pressure greater than ambient air); a gel; a paste; particles (e.g., polymer particles, foam particles, cellulose particles, rock or mineral particles, rubber particles, and the like), or a combination thereof. In some embodiments, the pod assembly 220 and the flow of material (e.g., ambient air) therein may provide appropriate cushioning to the wearer's foot. In one embodiment, one or more passageways 222 may include a restrictor for restricting the fluid flow between pods 221. The restrictor may prevent fluid (e.g., air) from rushing out of one or more pods 221 which could disrupt the cushioning provided by the pod assembly 220. For example, the restrictor may prevent air from rushing out of heel pod 228 upon heel strike when the pressure within the heel portion of the pod assembly 220 is increased. The shape or structure of the restrictor determines the amount of air that is permitted to pass through the passageway 222 at any given time. In one embodiment, the restrictor may comprise a narrowing of the passageway 222. Other shapes and structures of the restrictor may be used, including, but not limited, to those disclosed in U.S. Pat. No. 6,505,420, entitled "Cushioning Member for an Article of Footwear," the disclosure of which is incorporated herein in its entirety by reference thereto. The different structures of the restrictor may be accomplished during a blow-molding manufacturing process, for example. Accordingly, in some embodiments no complicated or expensive valve means need be attached to pod assembly 220.

Figure 3:
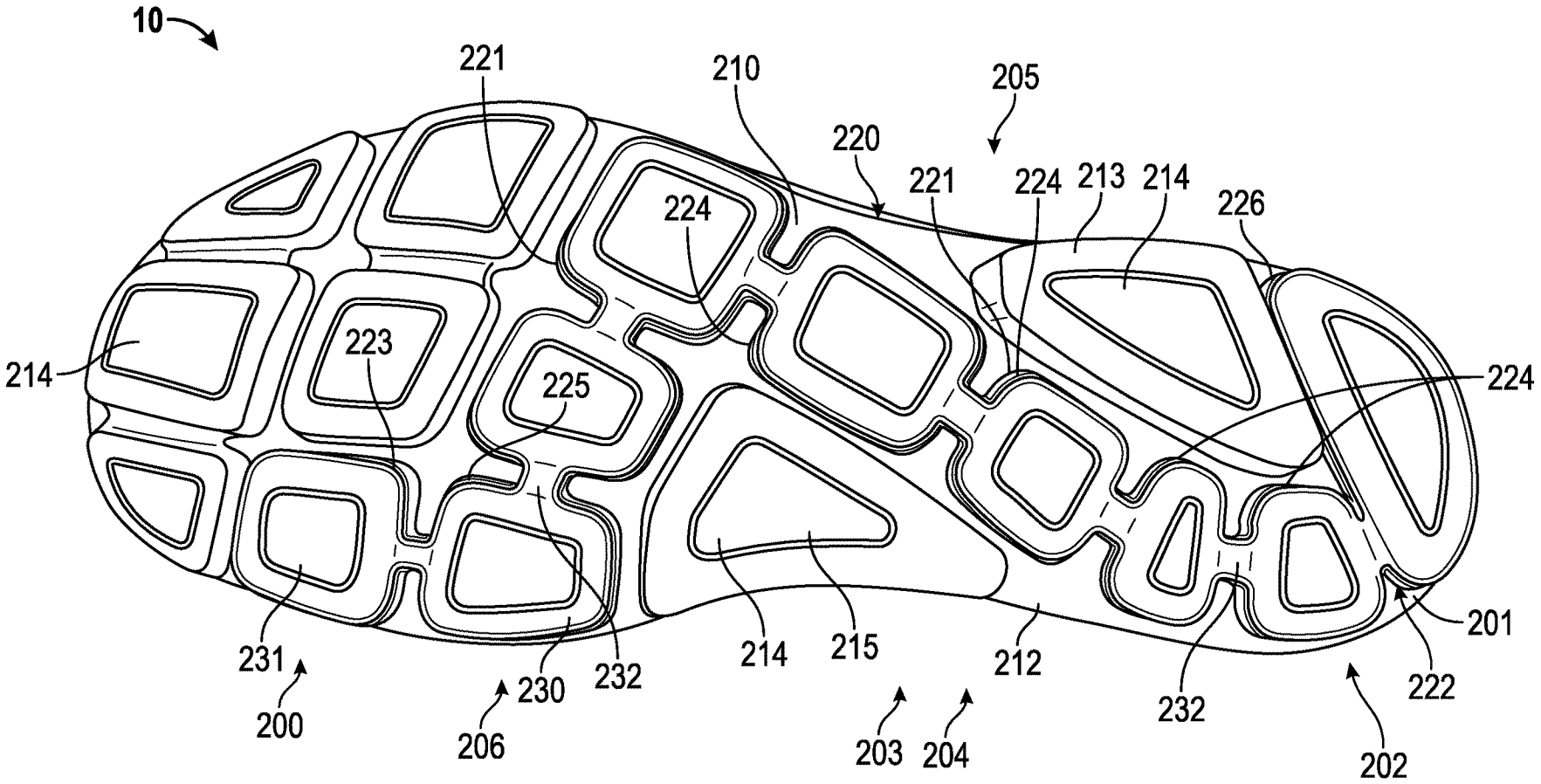
FIG. 3 is a bottom view of an exemplary article of footwear having a sole with a pod assembly according to an embodiment of the present invention.

In one embodiment, as shown, for example in FIGS. 1 and 3, the pod assembly 220 includes a plurality of pods 221 fluidly connected in a substantially curved arrangement and, in one embodiment, the pod assembly 220 may be in a substantially S-shaped arrangement. In this manner, the pod assembly 220 may provide continuous cushioning to the wearer's foot during a gait cycle such that a wearer's stride forces the material (e.g., ambient air) within the pod assembly 220 to flow in a manner complementary with respect to the wearer's stride and the application of forces to the anatomical structure of the foot.

With continued reference to FIGS. 1 and 3, for example, in one embodiment, the pod assembly 220 includes a first end pod 226 disposed in the heel portion 202 of the sole 200. In one embodiment, as shown, for example, in FIG. 3, the first end pod 226 may be a heel pod 226 disposed substantially on the lateral side 205 of the sole 200 in the heel portion 202. The heel pod 226 may be larger, and may contain more volume, on the lateral side 205 of the sole 200, and, thus, may be disposed substantially on the lateral side 205 of the sole 200 in the heel portion 202. In this manner, heel pod 226 may accommodate for a typical "heel strike" event which typically begins on the lateral side of the heel, and, thus, may substantially correspond with a heel strike event during a gait cycle of a wearer. In one embodiment, as shown, for example, in FIG. 1, the heel pod 226 has a curved outer edge 228 that corresponds to an outer edge 201 of the sole 200. In one embodiment, the outer edge 228 of the heel pod 226 is substantially flush with the outer edge of the sole 201. In one embodiment, the first end pod 226 may have a larger volume than each of the other plurality of pods 221.

In one embodiment, the pod assembly 220 may further include a second end pod 223 disposed in a forefoot portion 206 of the sole 200. In one embodiment, as shown, for example, in FIG. 3, the second end pod 223 may be a toe pod 223 disposed substantially on the medial side 203 of the sole 200 in the forefoot portion 206. In one embodiment, the second end pod 223 may substantially correspond with a toe-off event during a gait cycle of a wearer, which typically occurs on the medial forefoot side of the foot.

Figure 6:
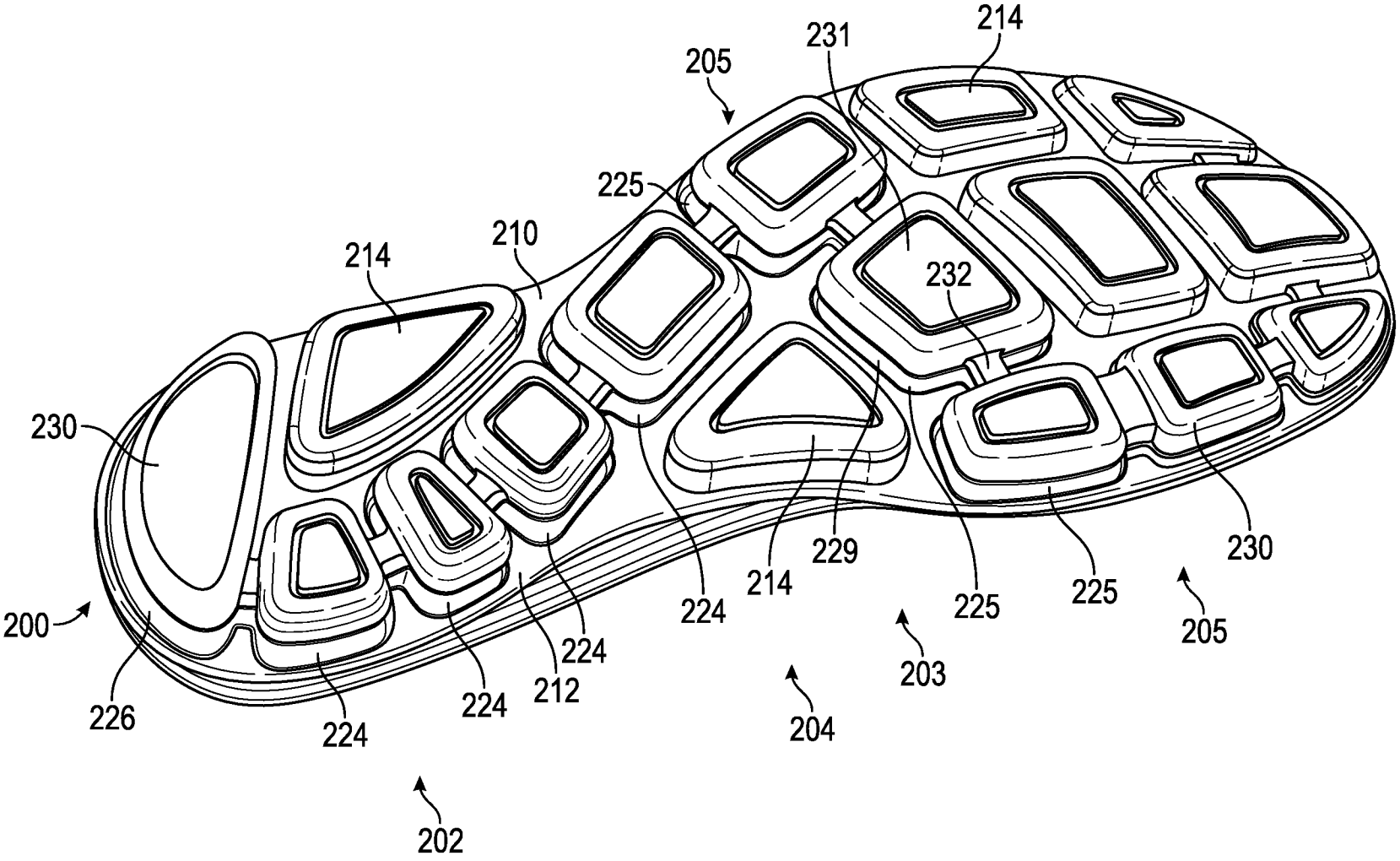
FIG. 6 is a bottom medial perspective view of a sole having a pod assembly according to an embodiment of the present invention.
Figure 7:
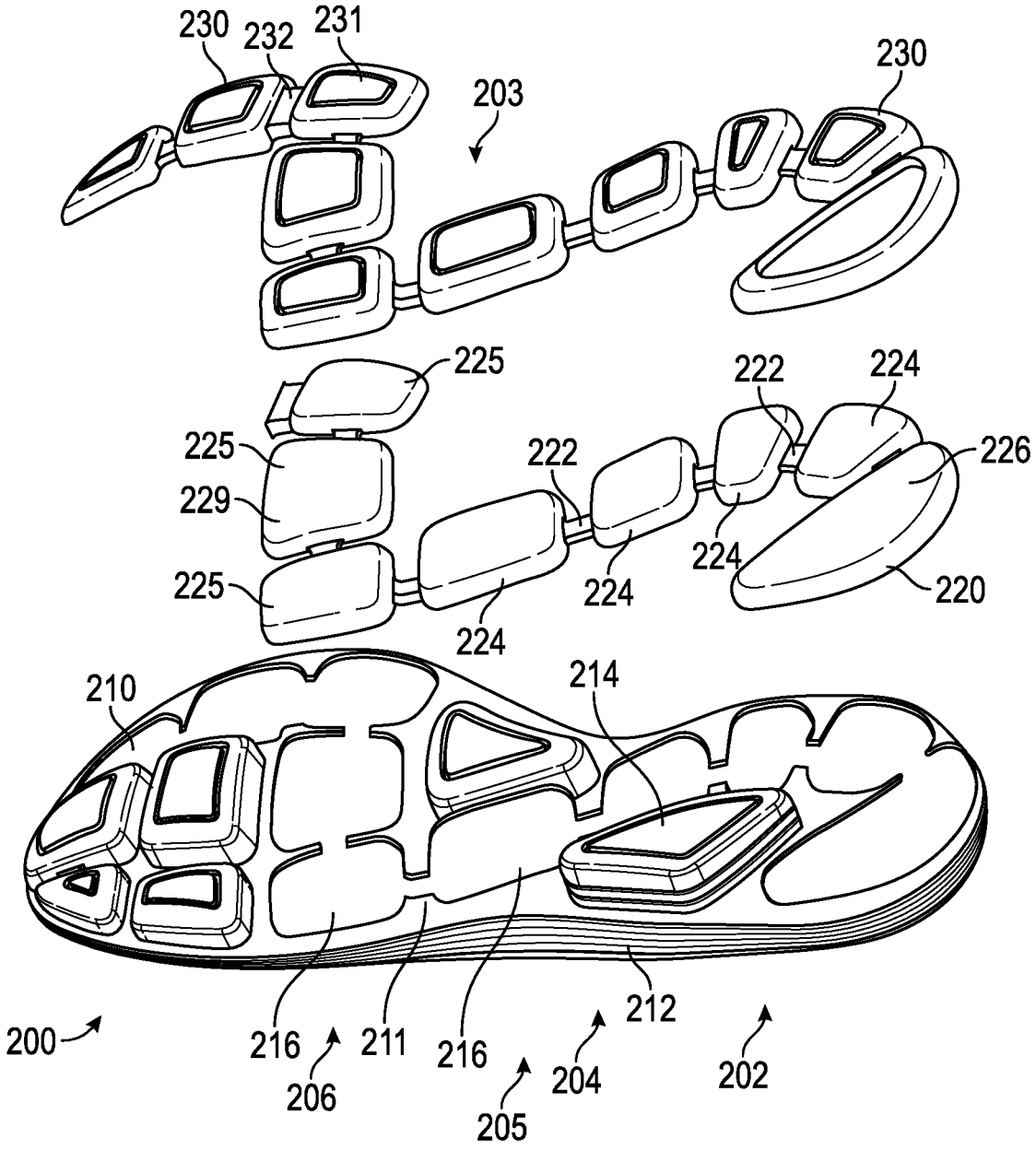
FIG. 7 is an exploded bottom lateral perspective view of the sole of FIG. 6 having a pod assembly according to an embodiment of the present invention.
Figure 8:
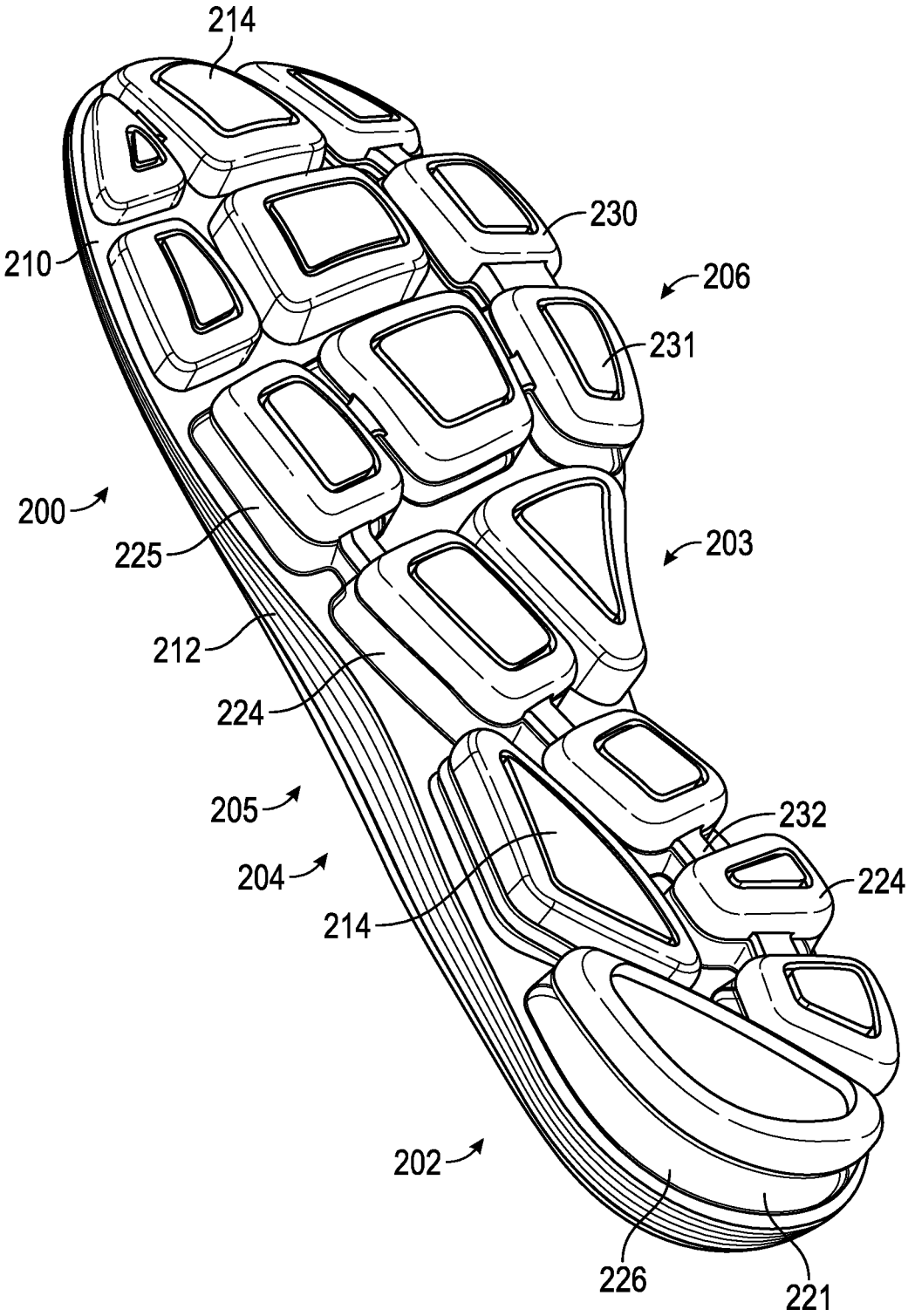
FIG. 8 is a bottom lateral perspective view of the sole of FIG. 6 having a pod assembly according to an embodiment of the present invention.
Figure 9:
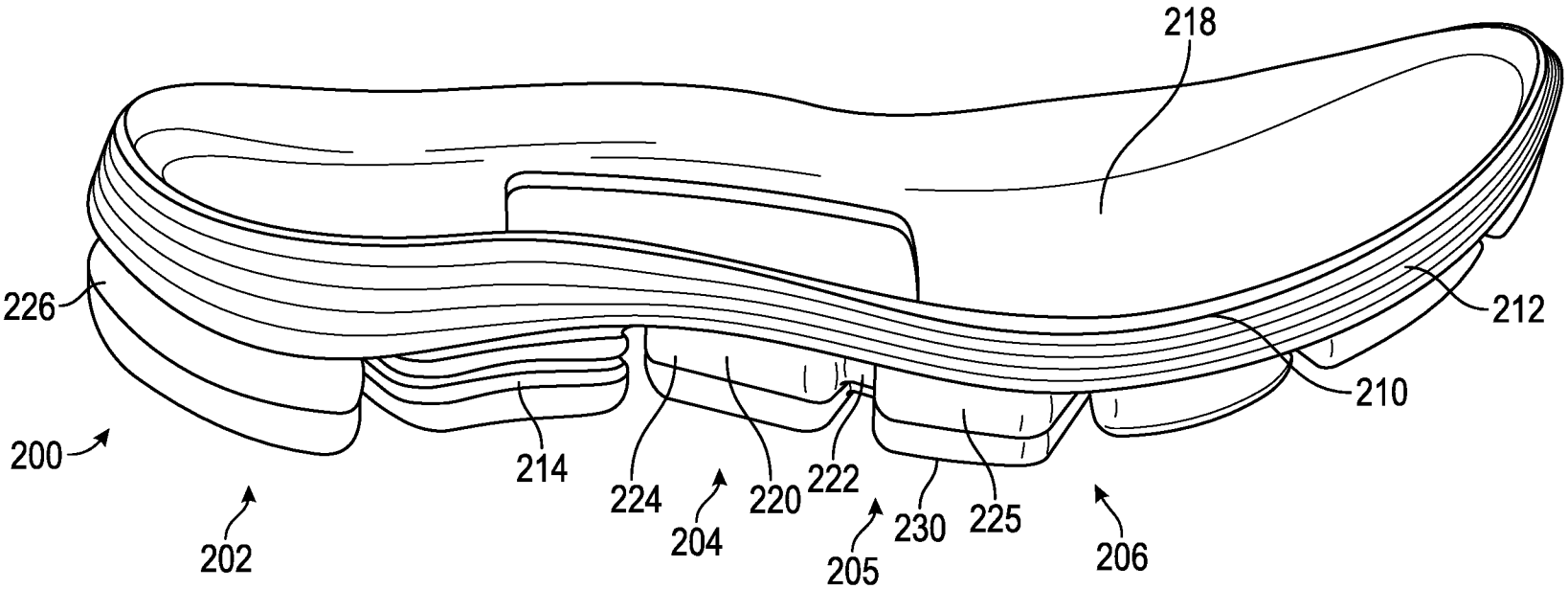
FIG. 9 is a lateral side view of the sole of FIG. 6 having a pod assembly according to an embodiment of the present invention.

The pod assembly 220 may further include a plurality of metatarsal pods 225 disposed between the first end pod 226 and the second end pod 223 in the forefoot region 206. The metatarsal pods 225 may include a plurality of pods that extend laterally along the width of the shoe from a medial side 203 of the sole 200 to a lateral side 205 of the sole 200 and generally corresponding to the location of the heads/ends of the metatarsals 118 in the foot of the wearer. In this manner, the location of the metatarsal pods 225 may correspond with the motion of the foot as it rolls medially during a typical gait cycle. The metatarsal pods 225 may also provide cushioning to a wearer that primarily has a forefoot striker gait. In one embodiment, the pod assembly 220 may include three metatarsal pods 225. In another embodiment, the pod assembly 220 may include greater than three metatarsal pods 225. In one embodiment, as shown, for example, in FIGS. 6 and 7, the central metatarsal pod 229 may be generally larger than adjacent metatarsal pods to enhance cushioning. In one embodiment, the central metatarsal pod 229 also may extend further from the upper sole portion 210 than adjacent metatarsal pods and thereby have a greater height profile. In one embodiment, as shown, for example, in FIGS. 6-9, the pod assembly 220 may not include a toe pod 223, and the second end pod 223 may correspond with the medial most metatarsal pod 225.

The pod assembly 220 may further include a plurality of longitudinal pods 224 disposed between the first end pod 226 and the metatarsal pods 225 and/or the second end pod 223. In one embodiment, the longitudinal pods 224 extend longitudinally along the length of the sole 200 from a medial side 203 of the sole 200 to a lateral side 205. The longitudinal pods may connect the heel pod 226 disposed substantially on the lateral side 203 of the sole 200 in the heel region 202 of the sole to a metatarsal pod 225 disposed in a forefoot region 206 of the sole. As best shown, for example, in FIG. 3, in one embodiment the heel pod 226 and the immediately adjacent longitudinal pod 224 (the rear most longitudinal pod 224) are connected via a passageway 222 on the medial side 205 of the heel pod 226 such that the rear most longitudinal pod 224 is disposed on the medial side 203 of the sole 200. In one embodiment, the longitudinal pods 224 may fluidly connect the pod assembly 220 through the midfoot region 204 of the sole from the heel region 202 to the forefoot region 206. In this manner, the longitudinal pods 224 may correspond with the motion of the foot during mid-stride of a typical gait cycle, that is, as the foot rolls toward its center axis in the midfoot region 104. In one embodiment, the pod assembly 220 may include four longitudinal pods 224. In other embodiments, more than four longitudinal pods 224 may be used.

In one embodiment, the plurality of pods 221 is fluidly connected in series and may be directly connected only to one or two immediately adjacent pods 221. In one embodiment, as best shown in FIG. 3, the first end pod 226 and the second end pod 223, which are disposed at the rearward most end and forward most end of the pod assembly 220 respectively, may only be directly connected only to one immediately adjacent pod 221 by a fluid passageway 222. In one embodiment, the pod assembly 220 includes only two end pods. The remaining pods 221 disposed between the end pods are directly connected only to two immediately adjacent pods 221 (one forward and one rearward). In one embodiment, the center point of a cross-sectional area of the pod is forward and/or rearward of the center point of any pods to which the pod 221 is directly connected.

Figure 10:
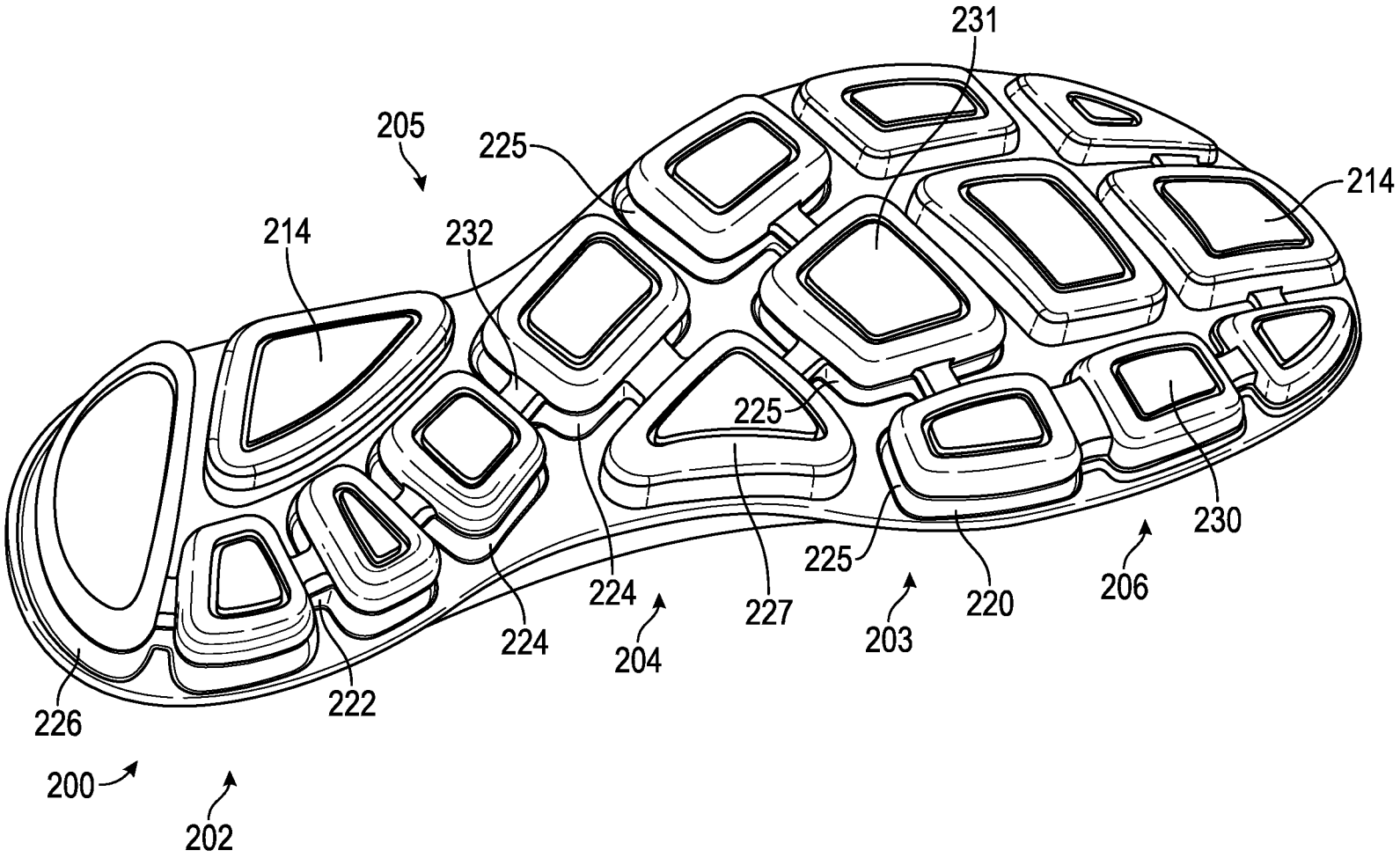
FIG. 10 is a bottom view of a sole having a pod assembly according to an embodiment of the present invention.
Figure 11:
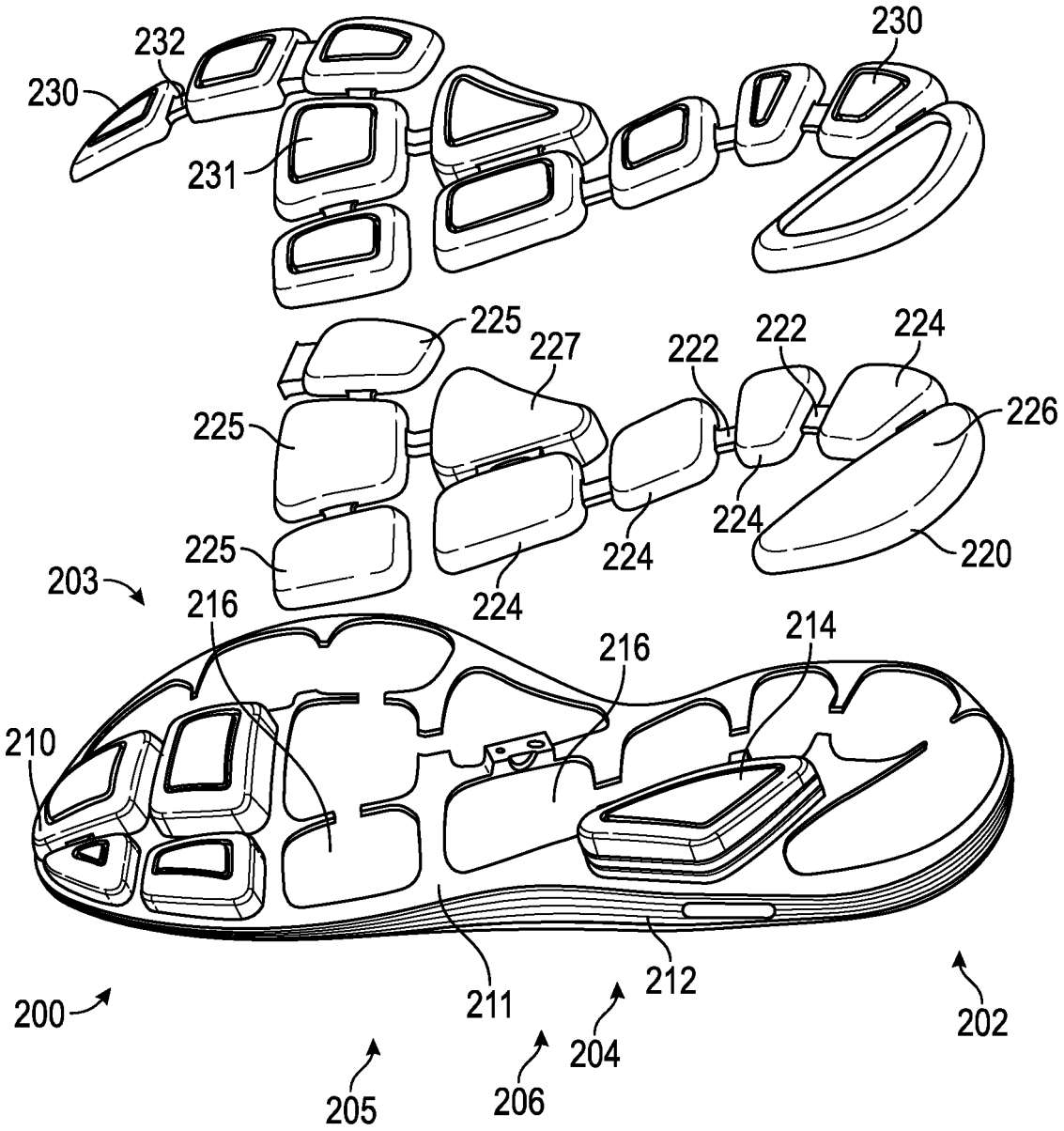
FIG. 11 is an exploded bottom lateral perspective view the sole of FIG. 10 having a pod assembly according to an embodiment of the present invention.

In one embodiment, as shown, for example, in FIGS. 10 and 11, the pod assembly 220 may include a midfoot pod 227 disposed on the medial side 203 of the sole 200 in the midfoot region of the sole. The midfoot pod 227 is generally disposed rearward of the metatarsal pods 225 and may be disposed intermediate to, and may fluidly connect to, the forward most longitudinal pod 224 and a metatarsal pod 225, as shown, for example, in FIG. 10. In one embodiment, the midfoot pod 227 may fluidly connect to the central metatarsal pod 229. In one embodiment, the midfoot pod 227 may be a cuneiform pod 227 generally corresponding to a cuneiform 112 of the wearer's foot. In one embodiment, the forward most longitudinal pod 224 may fluidly connect with the lateral most metatarsal pod 225 and the midfoot pod 227.

In one embodiment, fluid flow within the pod assembly 220 may not be continuous from the first end pod 226 (e.g., heel pod 226) to the second end pod 223. In an embodiment including midfoot pod 227, as shown, for example, in FIGS. 10 and 11, midfoot pod 227 may be fluidly connected to a metatarsal pod 225 (e.g., central metatarsal pod 229) but may not be fluidly connected to a longitudinal pod 224. In this manner, fluid flow may terminate intermediate to the longitudinal pods 224 and the metatarsal pods 225, thereby providing a pod assembly 220 in the forefoot region 206 and a pod assembly 220 in the midfoot 204 and heel 202 regions. In this embodiment, midfoot pod 227 may act as a reservoir into which fluid (e.g., air) evacuates as the metatarsal pods 225 compress. This configuration still provides for the plurality of pods to compress substantially in sequence through a gait cycle of a wearer, and may result in smoother air transfer and transition between peak heel force and forefoot toe-off, and, in particular, may manage the roll transition from the lateral side 205 to the medial side 203 during the gait cycle. In one embodiment, fluid flow may terminate by sealing the passageway 222 at the desired point of termination. In another embodiment, fluid flow may terminate simply by not providing a passageway 222 between the adjacent pods 221 at the desired point of termination. In one embodiment, a forefoot pod assembly 220 and a heel/midfoot pod assembly 220 may be molded separately.

In one embodiment, fluid flow may terminate at a point along the series of longitudinal pods 224. This may prevent, or reduce occasions of, fluid (e.g., air) evacuating heel pod 226 too quickly, for example, during a heel strike event, which may lead to the wearer experiencing heel cushioning that is too soft. In one embodiment, fluid flow may terminate immediately rearward of the metatarsal pods 225, for example, between the forward most longitudinal pod 224 and the lateral most metatarsal pod 225. In one embodiment, fluid flow may terminate between the second forward most longitudinal pod 224 and the forward most longitudinal pod 224. In one embodiment, fluid flow may terminate between the rearward most longitudinal pod 224 and the second rearward most longitudinal pod 224. In one embodiment, fluid flow may terminate between the second rearward most longitudinal pod 224 and the second forward most longitudinal pod 224. In one embodiment, fluid flow may terminate by sealing the passageway 222 at the desired point of termination. In another embodiment, fluid flow may terminate simply by not providing a passageway 222 between the adjacent pods 221 at the desired point of termination.

The number, size, and shape of the pods 221 of the pod assembly 220 may be varied to provide the desired ride characteristics. In one embodiment, the pod assembly 220 includes at least eight pods connected in series in a substantially curved, S-shaped arrangement. In one embodiment, the pod assembly 220 includes at least nine pods.

In one embodiment, one or more pods 221 are generally rectangular or quadrilateral in shape and have a generally block structure in appearance and cross-section. Other shapes, including but not limited to, circular, hexagonal, elliptical, and any other suitable shape may be used. In one embodiment, one or more pods 221 have a low height profile such that the distance that the pod 221 extends from the upper sole portion 210 (i.e., height in the z-direction) is substantially less than width and length of the pod to provide the desired air transfer during the gait cycle. In one embodiment, one or more pods 221 are generally crowned, as opposed to flat, on a top surface. This may serve to pre-load the pod assembly 220 and may provide desired balance between the cushioning and stability effects of the sole 200.

In one embodiment, the size (e.g., width and height) of the pods 221 in the pod assembly 220 may vary. For example, in one embodiment, the height of the pods 221 may generally decrease from the heel region 202 of the sole 200 to the forefoot region 206. In other embodiments, at least two of the pods 221 have generally the same height. For example, in some embodiments, at least adjacent two pods 221, oriented along the length of the sole from heel region 202 to the forefoot region 206, have generally the same height. In some embodiments, at least two of the pods 221 have generally the same volume.

In one embodiment, a lower sole portion 230 is disposed below the pod assembly 220. In one embodiment lower sole portion 230 includes one or more pod covers or caps 231 and one or more passageway portions 232. In one embodiment, the pod covers 231 have a concave, cup-like shape and may snugly cover the pods 221. In some embodiments, lower sole portion 230 may comprise an outsole and may include a ground contacting surface adapted to protect the pods 221 and passageways 222 of the pod assembly 220 from damage or routine wear. In some embodiments, all or a portion of the lower sole portion 230 may comprise a wear-resistant material. For example, outsole material can include synthetic or natural rubber, thermoplastic polyurethane (TPU), a wear-resistant foam, or a combination thereof. In some embodiments, the sole 200 may be constructed out of one or more materials and may have zones of differing densities.

In one embodiment, the upper sole portion 210 and the lower sole portion 230 are not attached and may thereby be decoupled. In some embodiments, this may allow the lower sole portion 230 to move independently of the upper sole portion 210 and the sole 200 may be adapted to provide particular ride features, including, but not limited to, providing a more fluid or soft feel to the wearer.

The pod assembly 220 may be formed of a suitably resilient material so that it may compress with the application of force and expand with the flow of the material (e.g., a fluid, a gel, a paste, or flowable particles) disposed inside, while also resisting breakdown. In one embodiment, pod assembly 220 may be formed of a polymer such as an elastomer and can be formed using any of various molding techniques known in the art. For example, pod assembly 220 may be blow molded, such as by injection blow molding or stretch blow molding. Further, other manufacturing methods can be used to form pod assembly 220, such as thermoforming and sealing, injection molding and sealing, vacuum forming and sealing or radio frequency (RF)/high frequency (HF) welding. The pod assembly may be coupled to the upper sole portion 210 and the lower sole portion 230 by adhesive bonding, welding, or other suitable technique.

In one embodiment, the pod assembly 220 may be molded such that one or more pods 221 have an asymmetrical or offset parting line. This may be used to provide different ride characteristics for the pod assembly 220 (or particular pods 221) depending on where the asymmetrical parting line is provided. In one embodiment, for example whereby the pod assembly 220 is made by extrusion blow molding, an asymmetrical parting line may be provided near the top of a pod 221, thereby creating a thicker wall near the top of the pod 221 and a thinner wall near the bottom of the pod 221. Unlike conventional inserts which may include a symmetrical part line in the middle of the component, this may result in a stiffer top portion of the pod 221 and a softer or more flexible bottom portion. In some embodiments, an asymmetrical parting line provided near the top of a pod 221 and the resulting greater wall thickness at the top of the pod 221 may prevent or reduce the feeling of air being "pillowed" against the bottom of the foot of the wearer. Such placement also may provide an aesthetic advantage by maintaining the part line out of view, for example, covered by upper sole portion 210.

Upper sole portion 210 may include a base 212 which may be attached to the upper 20 by adhesive bonding, welding, or other suitable technique. The upper sole portion 210 may include a top surface 218 (as shown, for example, in FIG. 9) generally shaped to accommodate the contours of the foot. One or more recesses 216 are formed in a bottom surface 211 of the base 212 (as shown, for example, in FIGS. 7 and 11). The recesses 216 are sized and shaped for receiving a corresponding pod 221 of the pod assembly 220. The recesses 216 are disposed on the bottom surface 211 of the base 212 in a manner that corresponds to the arrangement of the pod assembly 220. In this manner, in one embodiment, a plurality of recesses 216 may be formed in the bottom surface 211 of the base 212 in a substantially curved, S-shaped arrangement. In one embodiment, upper sole portion 210 may include a rigid plate (not shown) comprising a rigid material including, but not limited to, thermoplastic, such as, for example, TPU, or a fiber-reinforced polymer.

In one embodiment, upper sole portion 210 includes a plurality of projections 214 extending from the base 212. The projections 214 are disposed around the pods 221 of the pod assembly and may be adapted to provide additional cushioning and/or stability for the sole 200. As shown, for example, in FIGS. 3, 6, and 10, in one embodiment the sole 200 may include a large heel projection 213 disposed in the heel region 202 of the sole 200 and a large midfoot projection 215 disposed in the midfoot region 204 of the sole 200. In one embodiment, as shown, for example, in FIGS. 10 and 11, the midfoot pod 227 may be provided instead of the midfoot projection 215. The number, size, and shape of the projections 214 may be varied to provide the desired ride characteristics of the footwear. In one embodiment, sole 200 may include at least 5 projections 214. In one embodiment, sole 200 may include 7 projections 214.

Figure 4:
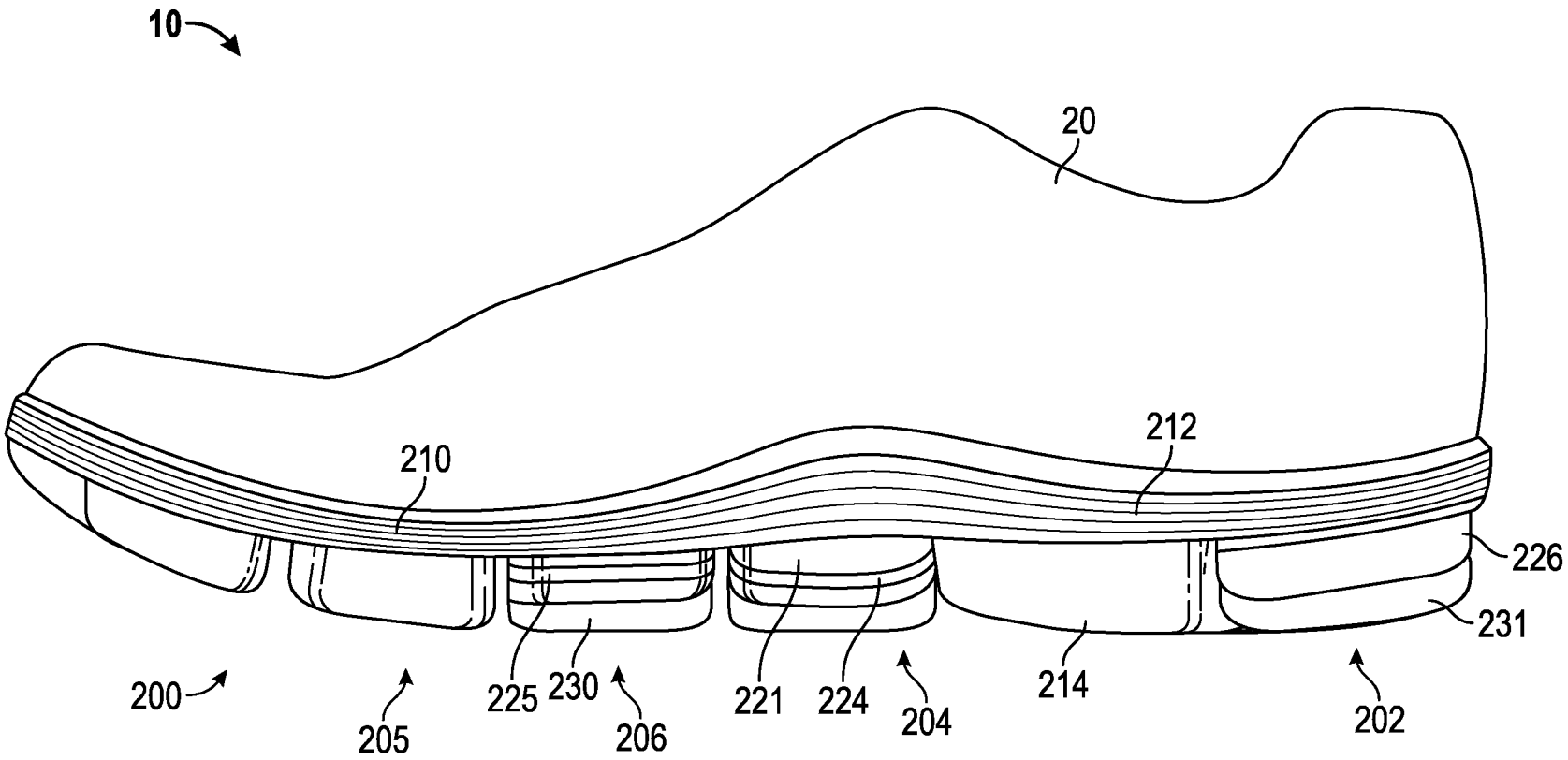
FIG. 4 is a lateral side view of an exemplary article of footwear having a sole with a pod assembly according to an embodiment of the present invention.
Figure 5:
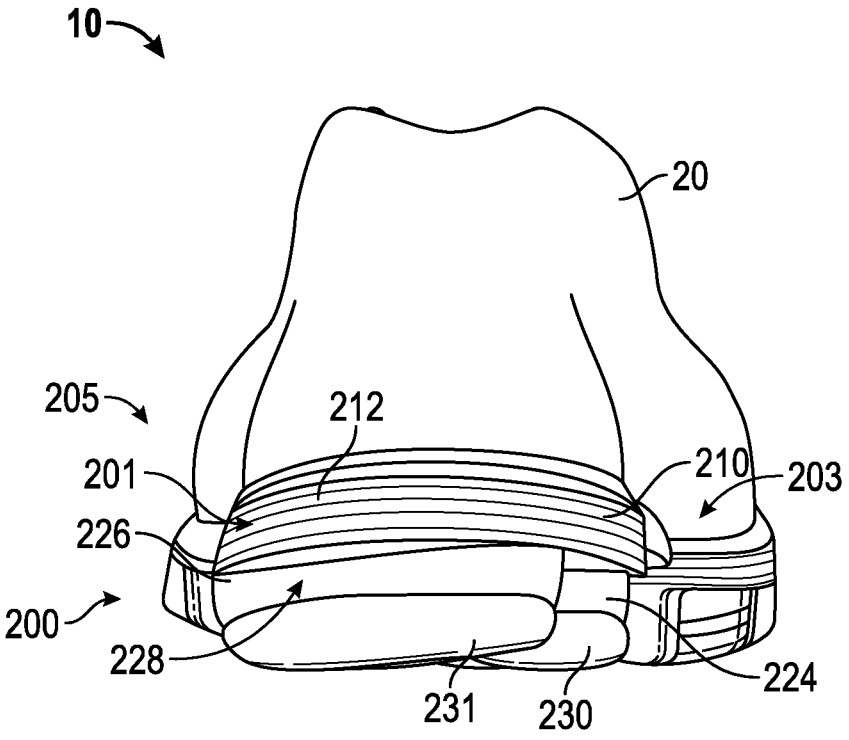
FIG. 5 is a rear view of an exemplary article of footwear having a sole with a pod assembly according to an embodiment of the present invention.

In one embodiment, a portion of pod assembly 220 may be visible from the exterior of the sole 200. For example, as shown in FIGS. 4 and 5, one or more projections 214 may extend from the upper sole portion 210 such that only a portion of a plurality of pods 221 is visible from the exterior of the sole 200. In another embodiment, one or more pod assemblies 220 may not be visible.

The upper sole portion 210 comprises a material for providing the desired cushioning, ride, stability, and/or durability of the sole 200. Suitable material for the upper sole portion 210 may include, but is not limited to, foam and thermoplastic polyurethane. When the upper sole portion 210 comprises a foam, the foam may comprise, for example, ethyl vinyl acetate (EVA) based foam or polyurethane (PU) based foam and the foam may be an open-cell foam or a closed-cell foam. In other embodiments, the upper sole portion 210 may comprise elastomers, thermoplastic elastomers (TPE), foam-like plastic, and gel-like plastics. In some embodiments, both the upper sole portion 210 and the lower sole portion 230 include the same material. In some embodiments, the lower sole portion 230 comprises only outsole material. In one embodiment, an insole and/or sockliner may also be included within the shoe 10. In some embodiments, the sole 200 may include an insole and/or sockliner.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A sole for an article of footwear, comprising:

an upper sole portion having a base;

a plurality of recesses formed in a bottom surface of the base; and a pod assembly having a plurality of pods fluidly connected in series disposed below the upper sole portion, wherein the pod assembly extends from a lateral side of the sole in a heel region of the sole to a medial side of the sole in a forefoot region of the sole such that the plurality of pods are adapted to compress in sequence through a gait cycle of a wearer, wherein the pod assembly includes a first end pod adapted to correspond with a heel strike event during the gait cycle of the wearer, the first end pod disposed on the lateral side of the sole and having a larger volume than each of the other pods of the plurality of pods, wherein the first end pod is connected to an immediately adjacent pod of the plurality of pods via a first time passageway disposed on a medial side of the first end pod, wherein the first end pod comprises an outer edge that extends to an outer edge of the sole, and wherein the plurality of recesses are adapted to receive the plurality of pods.

2. The sole of claim 1, wherein the pod assembly includes a second end pod disposed on the medial side of the sole adapted to correspond with a toe off event during the gait cycle of the wearer.

3. The sole of claim 2, wherein the pod assembly includes a plurality of fluid passageways such that the first fluid passageway is one of the plurality of fluid passageways, wherein the first end pod is directly connected only to the first fluid passageway of the plurality of fluid passageways, and wherein the second end pod is directly connected only to a second fluid passageway of the plurality of fluid passageways.

4. The sole of claim 3, wherein each of the plurality of pods disposed between the first end pod and the second end pod is directly connected only to a respective set of two of the plurality of fluid passageways.

5. The sole of claim 1, wherein the pod assembly is substantially S-shaped.

6. The sole of claim 1, wherein the upper sole portion comprises foam.

7. The sole of claim 1, further comprising a lower sole portion disposed below the pod assembly.

8. The sole of claim 1, wherein the plurality of pods comprises greater than 5 pods.

9. The sole of claim 1, wherein the plurality of pods comprises 9 pods.

10. A sole for an article of footwear, comprising:

a foam upper sole portion; and a pod assembly disposed below the upper sole portion and extending from a first end pod of the pod assembly disposed on a lateral side of the sole in a heel region of the sole to a second end pod of the pod assembly disposed on a medial side of the sole in a forefoot region of the sole, the pod assembly having at least five pods, including the first end pod and the second end pod, fluidly connected in series in a substantially curved arrangement, wherein the at least five pods comprises a pod immediately adjacent to the first end pod, wherein the immediately adjacent pod is disposed on the medial side of the sole, wherein the pod assembly is visible from an exterior of the sole, and wherein the pod assembly is substantially S-shaped from the first end pod to the second end pod.

11. The sole of claim 10, wherein the pod assembly is filled with air at ambient pressure.

12. The sole of claim 10, wherein the first end pod has a larger volume than each of the other pods of the at least five pods.

13. The sole of claim 10, wherein the first end pod has a curved outer edge that corresponds to a portion of the heel region of the sole.

14. The sole of claim 10, wherein the second end pod is adapted to correspond with a metatarsal area of a wearer's foot.

15. The sole of claim 10, wherein the second end pod is adapted to correspond with a toe off event during a gait cycle of a wearer.

16. The sole of claim 10, further comprising a plurality of projections extending from the upper sole portion.

17. The sole of claim 10, wherein the pod assembly is hollow.

18. A sole for an article of footwear, comprising:

an upper sole portion having a base;

a plurality of recesses formed in a bottom surface of the base; and a pod assembly having a plurality of pods fluidly connected in series disposed below the upper sole portion, wherein the pod assembly extends from a lateral side of the sole in a heel region of the sole to a medial side of the sole in a forefoot region of the sole such that the plurality of pods are adapted to compress in sequence through a gait cycle of a wearer, wherein the pod assembly includes a first end pod adapted to correspond with a heel strike event during the gait cycle of the wearer, the first end pod disposed on the lateral side of the sole and having a larger volume than each of the other pods of the plurality of pods, wherein the plurality of pods comprises a pod immediately adjacent to the first end pod, and wherein the immediately adjacent pod is disposed on the medial side of the sole, wherein the first end pod comprises an outer edge that extends to an outer edge of the sole, and wherein the plurality of recesses are adapted to receive the plurality of pods.

19. The sole of claim 18, wherein the pod assembly includes a second end pod disposed on the medial side of the sole adapted to correspond with a toe off event during the gait cycle of the wearer.

* * * * *